United States Patent [19]

Fischer et al.

[11] Patent Number: 4,956,988

[45] Date of Patent: Sep. 18, 1990

[54] MANDREL ROD FOR PIPE ROLLING MILLS

[75] Inventors: Francis Fischer, Sins; Jean-Paul Calmes, Grandvaux; Alain Cron, Hildisrieden, all of Switzerland

[73] Assignee: Lonza Ltd., Gampel, Switzerland

[21] Appl. No.: 396,917

[22] Filed: Aug. 22, 1989

[30] Foreign Application Priority Data

Aug. 31, 1988 [CH] Switzerland ..... 03254/88

[51] Int. Cl.[5] ..... B21B 25/00; B21B 25/04

[52] U.S. Cl. ..... 72/208; 72/97; 72/201

[58] Field of Search ..... 72/96, 97, 208, 209, 72/201, 370, 465, 466

[56] References Cited

U.S. PATENT DOCUMENTS

| | | | |
|---|---|---|---|
| 1,989,507 | 1/1935 | Diescher | 72/208 X |
| 3,577,754 | 5/1971 | Calmes | 72/209 X |
| 3,918,284 | 11/1975 | Reiley et al. | 72/97 |
| 4,819,471 | 4/1989 | Cook | 72/208 X |

FOREIGN PATENT DOCUMENTS

| | | | |
|---|---|---|---|
| 3429524 | 2/1986 | Fed. Rep. of Germany | 72/209 |
| 55-103203 | 8/1980 | Japan | 72/208 |

*Primary Examiner*—E. Michael Combs

*Attorney, Agent, or Firm*—Fisher, Christen & Sabol

[57] ABSTRACT

Mandrel rod (1) for pipe rolling mills, in which hollow billet (5) is rolled on mandrel rod (1), consists of two pipes (2, 3) lying inside one another. Annular gap (4) between pipes (2, 3) is filled with a thermosetting plastic, whose coefficient of expansion is selected large enough so that the thermosetting plastic completely fills annular gap (4), even with temperature differences, between pipes (2, 3).

14 Claims, 1 Drawing Sheet

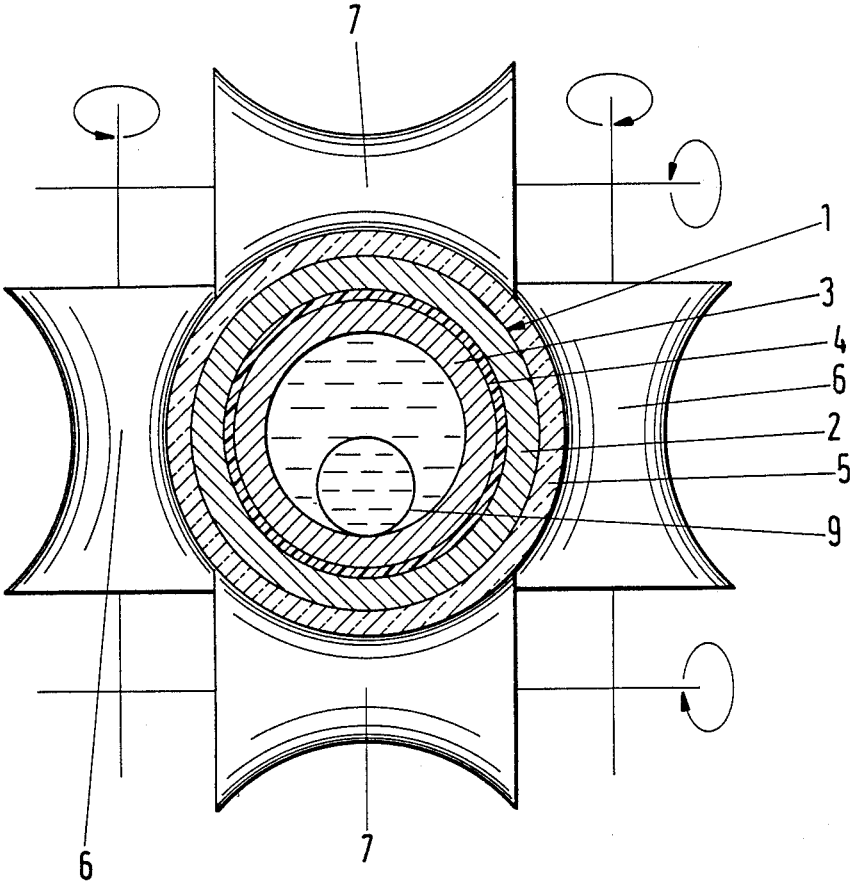
7
1
3
4
6
2
5
9
6
7

MANDREL ROD FOR PIPE ROLLING MILLS

BACKGROUND OF THE INVENTION

1. Field of the Invention

The invention relates to a mandrel rod for pipe rolling mills where a hollow billet is rolled on the mandrel rod.

2. Background Art

Mandrel rods of this type are used for the hot rolling of pipes, especially in the so-called MPM (multiple pipe mill) process, as well as in the push bank process and in continuous pipe rolling mills (so-called continuous mill trains), and the hollow billet is rolled on the mandrel rod. (A hollow billet is understood herein to mean the hollow cylindrical intermediate product during pipe production.) The rod head can be rounded or provided with a plug of the same diameter. The wall of the hollow billet is rolled out by several roller pairs that lie horizontally and vertically opposite one another and that press the hollow billet against the mandrel rod. The mandrel rod that is moved along with the hollow billet is located, during the entire rolling operation, inside of the hollow billet and is heated by its temperature and the rolling process. After the rolling operation, it is pulled out of the hollow billet and stored to cool. For the subsequent rolling operation, another already-cooled mandrel rod is used.

Mandrel rods of this type, on which the hollow billet is rolled, are to be differentiated from those mandrel rods of another type that are used only as carriers of a plug on which the hollow billet is rolled. These mandrel rods used in plug mills have a smaller diameter than the plug, thus do not come in contact with the hollow billet and thus do not have to absorb radial rolling forces.

High demands are placed on the quality of the mandrel rods of the type mentioned above with respect to their surface hardness, straightness, surface quality and absence of deformation during rolling. During the rolling operation, the mandrel rod must be able to withstand large radial compressive forces. The mandrel rods, which can have diameters of several tens of centimeters, have up to now been rolled or forged as solid rounds whose surface was treated (finished and hardened) and into which axial bore holes were drilled for a coolant. The production and processing of the round in the required quality and length (over ten meters) was costly and expensive.

BROAD DESCRIPTION OF THE INVENTION

The object of the invention is to provide an economical, deformation-free, light and yet stable mandrel rod.

The mandrel rod of the invention achieves the object of the invention.

The invention involves a mandrel rod for pipe rolling mills in which a hollow billet is rolled on the mandrel rod, characterized by at least two pipes lying inside one another.

Preferably the pipes lying inside one another consist of steel. Preferably the pipes lying inside one another are separated radially from one another by at least one interspace in which a force transmission means is placed that transmits the rolling forces acting on the outer pipe or on the inner pipe or pipes so that the outer pipe is braced by the inner pipe or pipes. Also, preferably the pipes lying inside one another are placed coaxial to one another and wherein the difference between the inside diameter of the outer pipe and the outside diameter of the inner pipe, as well as the coefficient of expansion of the force transmission means are dimensioned so that the varying expansion of the pipes resulting from the heat acting during rolling on the outer pipe and conducted from the latter to the force transmission means is approximately equalized by the expansion of the force transmission means.

Preferably the force transmission means is a thermosetting plastic that at least partially fills the interspace. Preferably the force transmission means consist of an epoxy resin for a furan resin. Preferably an additive is mixed with the force transmission means to influence its heat conductivity and/or its coefficient of expansion. Preferably the additive consists of inorganic fibers or metal powder.

Preferably the outer pipe, compared to the inner pipe or pipes, has an increased outer hardness and quality. Preferably the outer pipe consists of high alloy steel, preferably nickel steel, and the inner pipe or pipes consist of tonnage steel. Preferably a cooling pipe is placed in the inner or innermost pipe. Preferably there are cooling channels in the interspace or at least in one of the interspaces.

One of the advantages of the invention is seen especially in the fact that the pipes from which the mandrel rod is built can be produced simply and economically by rolling with relatively thin pipe walls. Here, the outer pipe can consist of high quality steel with homogeneous structure and the inner pipe (or the inner pipes) can consist of tonnage steel exhibiting no special usage or quality properties. The steel alloy of the outer pipe can be selected so that it is optimally suited for surface working and tempering or hardening and exhibits a great toughness to the high rolling forces. The low weight of the outer pipe here facilitates the working of its outer surface.

The pipes lying inside one another are suitably placed coaxial to one another and are separated radially from one another by at least one interspace (annular gap) in which an elastic force transmission means is placed that transmits the rolling forces acting on the outer pipe to the inner pipe or pipes so that the outer pipe is braced by the inner pipe or pipes. The sandwichlike structure of the mandrel rod additionally has the advantage that the stiffnesses of the individual pipes have a cumulative effect. The gap width of the interspace and the coefficient of expansion of the force transmission means are preferably dimensioned so that the varying expansion of the pipe resulting from the heat that acts during rolling on the outer pipe is conducted from the latter to the force transmission means is approximately equalized by the expansion of the force transmission means, and the elasticity of the force transmission means absorbs the remaining differences in the thermal expansion of the sandwichlike structure. The material of the force transmission means is suitably selected so that its coefficient of expansion is a multiple of that of the pipe material.

The pipes can also be shrunk onto one another so that they lie nonpositively inside one another during maximum heating as well as after cooling which, however, would cause a more complicated and expensive production than with the sandwich structure.

As an elastic force transmission means, thermosetting plastics, such as, epoxy resins or furan resins, can be used with which one or more additives can be mixed to influence the value of the coefficient of expansion and the heat conductivity. Preferably, inorganic fibers, such as, carbon or silicon carbide fibers or a metal powder, e.g., iron or steel powder are mixed in, whose amount is selected so that, on the one hand, no or only minimal thermal deformations occur between the outer and inner pipe (or inner pipes) and, on the other hand, a good viscosity of the means is achieved.

The force transmission means can consist of thermally insulating, elastic material so that no or only a negligible amount of heat is transmitted from the outer pipe to the inner pipe (or inner pipes). In this way, the inner pipe remains at a constant temperature and acts as a mechanical stabilizing element for the entire mandrel rod.

Preferably, the outer pipe has, compared to the inner pipe or pipes, a great surface hardness and quality. Its wall thickness is suitably selected to be large enough so that the temperature on its inner surface always remains around a sufficient tolerance below the decomposition temperature (glass transition temperature) of the thermosetting plastic acting as the force transmission means.

The outer pipe can be produced of a high alloy steel, preferably a steel of high toughness alloyed with chromium and the inner pipe of a common, inexpensive steel such as, e.g., St-37, and, to increase its surface hardness, the outer pipe can be coated with a hard layer, preferably chromium.

The inner or innermost pipe can be closed in front and be open in the rear and, for cooling, a coolant line can be run through the hollow space of the pipe by which the coolant is conveyed to the front end of the inner pipe and from there flows rearward while cooling the pipe's inner wall.

In another preferred embodiment, cooling channels are located in the interspace between the pipes. For example, thin, small cooling pipes can be inserted into the interspace and the latter can be sealed with a thermosetting plastic.

BRIEF DESCRIPTION OF THE DRAWING

Embodiments of the mandrel rod according to the invention will be explained below in more detail based on the drawing.

In the drawing:

The FIG. shows a diagrammatic cross section through a mandrel rod according to the invention with roll stands usual during the rolling of a hollow billet.

DETAILED DESCRIPTION OF THE INVENTION

Mandrel rod 1 consists of an outer pipe 2 and an inner pipe 3 coaxial to outer pipe 2. Between the two pipes 2 and 3 there is an annular gap 4 as an interspace that is filled with a plastic. Hollow billet 5 is pressed against mandrel rod 1 by working roll 76 and 7 lying horizontally and vertically opposite one another. Mandrel rod 1 is closed on its front face end in the rolling direction.

Outer pipe 2 of mandrel rod 1 is a rolled pipe of high alloy steel, preferably a steel alloyed with chromium. The alloying results in great toughness. The pipe's outer surface is chrome plated to make it as hard and smooth as possible, which is decisive for feeding. The toughness as well as the hard and smooth surface of outer pipe 2 reduce its wear during the rolling operation. The wall thickness of the pipe is, e.g., 25 millimeters.

Inner pipe 3 is also a rolled pipe and consists of inexpensive tonnage steel, e.g., ST-37. The object of inner pipe 3, as described further below, is to brace outer pipe 2 by the plastic as a force transmission means in annular gap 4. In addition to the required mechanical sturdiness for bracing, no other requirements are thus made of the material of inner pipe 3. Its wall thickness is, e.g., 20 millimeters.

Annular gap 4 has a width of several millimeters and, as explained already above, is completely filled with a thermosetting plastic that adheres firmly to the inner surface of outer pipe 2 as well as to the outer surface of inner pipe 3. As can be seen for reasons explained further below, preferably an epoxy resin is used into which inorganic fibers or a metal powder are mixed as additives.

Inside of inner pipe 3 there lies a cooling pipe 9 that is attached (in a way not represented) in the vicinity of the rear end of mandrel rod 1. Cooling pipe 9 ends several centimeters in front of the front face of mandrel rod 1. It is open on its front end facing the face wall and it carries, on its rear end, a coolant connection (not represented) for connection to the outlet of a heat exchanger (not represented) of a coolant cycle (not represented). The coolant, preferably water or oil, runs in cooling pipe 9 in the direction of the face well and between the outer wall of cooling pipe 9 and the inner wall to be cooled of inner pipe 3. The rear end of mandrel rod 1 carries another connection (not shown) to which the heated coolant, flowing back, is connected to the entry to the heat exchanger (not represented).

To produce mandrel rod 1, outer and inner pipes 2 and 3 can be placed inside one another coaxially, vertically and annular gap 4, lying between them, can be sealed, fluid-tight, on its lower end. Next annular gap 4 is filled with the thermosetting plastic with which an additive is optionally mixed. The filling operation can occur depending on the thermosetting plastic, for example, by casting or by extrusion. After the thermosetting plastic hardens and cooling pipe 9 is inserted, mandrel rod 1 is ready for use.

During the rolling, outer pipe 2, at its outer side, is in intimate contact with the hot inner side (about 1200° C.) of hollow billet 5. The wall thickness of outer pipe 2 is, as mentioned, about 25 millimeters. The temperature of the inner wall of outer pipe 2 rises during the rolling operation because of the heat conductivity and heat capacity of the pipe material (to about 200° to a maximum of 350° C.) and remains clearly below the decomposition temperature (glass transition temperature) of the thermosetting plastic of about 400° C., which lies closely to the inner wall of outer pipe 2. Until the beginning of the next rolling operation, mandrel rod 1 again cools off (to about 90° C.).

During the heating and cooling cycles during rolling and intermediate storage, the temperature on the outer side of outer pipe 2 varies by about several hundred degrees Celsius, (about between 780° and 880° C.) and the temperature on the inner side, depending on the wall thickness and rolling time (several seconds), by somewhat more than two hundred degrees (about between 200° to 350° and 80° C.). In contrast, the temperature of inner pipe 3, because of the slight heat conductivity of thermosetting plastic and the width of annular gap 4 of a few millimeters is nearly constant (about 80° to 150° C.).

Because of the temperature remaining approximately constant, the dimensions of inner pipe 3 are approximately constant while the longitudinal and radial dimensions of outer pipe 2 change relatively greatly, which causes a corresponding change in the height of annular gap 4. The coefficient of expansion of the thermosetting plastic is adjusted by the previously mentioned additives so that it is high enough for the thermosetting plastic, by its thermal expansion in the temperature interval occurring, always completely to fill annular gap 4. The coefficient of expansion of the thermosetting plastic with additives mixed in is greater than that of steel by a multiple. Tolerances in the expansion are equalized by the elasticity of the thermosetting plastic. The amount of additive is selected suitably in the range between 10 to 70 percent by weight, preferably 40 to 50 percent by weight, and the viscosity, with an increasing portion of additive, becomes greater and the upper limit of the additive portion is given by the maximum allowable viscosity.

The wall thickness of outer pipe 2 is selected thick enough so that a sufficient mechanical rigidity, hardness and resistance to deformation is given during the rolling operation relative to the mechanically softer thermosetting plastic in annular gap 4, i.e., the relatively high surface pressure of rolls 6 and 7 is transmitted to a sufficiently large surface of the thermosetting plastic. It is furthermore so thick that, by the heat conduction from the outer side to the inner side of pipe 2, the temperature on the inner side always remains around a sufficient tolerance below the decomposition temperature (glass transition temperature) of the thermosetting plastic. But it is selected thin enough so that outer pipe 2 can be produced economically in good quality by rolling.

The wall thickness of inner pipe 3 results from the maximum radial rolling force occurring that mandrel rod 1 must absorb. This rolling force acts on outer pipe 2 and, by the thermosetting plastic as the force transmission means, on inner pipe 3, and the force transmission, as represented above, is guaranteed over the entire temperature range occurring. Both pipes 2 and 3 absorb the rolling forces together. When annular gap 4 is not completely filled, the danger can occur that outer pipe 2 bends and a satisfactory rolling is no longer possible.

Among other things, the quality of a rolled pipe depends on its linearity and, thus, on the straightness and absence of the thermal deformation of the mandrel rod. With standard, solid mandrel rods, the absence of deformation can be achieved, if at all, only with great expense (ensuring a homogeneous structure of the entire mandrel rod material, even cooling, tempering). A locally asymmetrical radial heating or cooling causes, just as in a solid, sturdy rod, thermal stresses also in outer pipe 2 and the thermal stresses consist of radial stresses, tangential and axial stresses. Compared to the tangential and axial stresses, the radial stresses, especially on a pipe with varying temperature of the outer and inner surface, are small, and the tangential and axial stresses on the lateral surface area assume peak values. If they no longer occur symmetrically, the tangential and axial stresses lead to deformation of the pipe or of the rod, and asymmetries from the slightest differences in the material composition or uneven heating or cooling can occur. Surprisingly, it has now been found that mandrel rod 1 according to the invention behaves significantly more deformation-stable than a solid mandrel rod of the standard type. This effect may be ascribed to the fact that, with mandrel rod 1 according to the invention, inner pipe 3, because of the thermal insulation by the layer of thermosetting plastic, is kept almost temperature-stable during the entire rolling and subsequent cooling storage cycle. Because of the way it is produced, outer pipe 2 is homogeneous and thus deformation-free to a large extent, but if uneven cooling or heating should occur, possible deformation forces on outer pipe 2 are eliminated by stable inner pipe 3. But in a standard mandrel rod a great deformation would take place under the same circumstances.

The rolling forces on mandrel 1, as already explained above, are absorbed by outer and inner pipes 2 and 3. Also besides the danger of deformation, a single pipe cannot be used since it cannot be produced by rolling with the required wall thickness. The use of pipes produced by rolling for mandrel rods 1 has the advantage that the latter can be produced economically with the required homogeneity and surface quality.

Instead of two pipes 2 and 3, several pipes can also be used and adjacent pipes are separated from one another by an annular space that is filled with a thermosetting plastic. The use of more than two pipes has the advantage that pipes with thinner walls can be used that can be produced even more simply and economically, but the drawback is that the production expense of the mandrel rod is increased and, for the gap of the outer pipes, thermosetting plastics should be used that exhibit a high temperature stability.

Instead of cooling pipe 9, there can also be embedded inside of pipe 3 several thin pipes in the thermosetting plastic for cooling. Instead of these pipes, the surface of the inner pipe can also be configured by lugs glued or welded on so that, when inserted into outer pipe 2 and subsequently lined, usable hollow spaces for a coolant cycle result.

What is claimed is:

1. Mandrel rod (1) for pipe rolling mills in which hollow billet (5) is rolled on mandrel rod (1), comprising a metallic outer pipe (2) and at least one metallic inner pipe (3) lying inside one another, said outer pipe (2) being separated radially from said at least one inner pipe (3) by a force transmission means consisting essentially of a non-metallic, solid-state material (4) that transmits the rolling forces acting on said outer pipe (2) to said at least one inner pipe (3) so that said outer pipe (2) is braced in a sandwich-like manner by said at least on inner pipe (3).

2. The mandrel rod according to claim 1 wherein said solid-state material (4) is a plastic material.

3. The mandrel rod according to claim 1 wherein said solid-state material (4) is an elastic material.

4. The mandrel rod according to claim 1 wherein said outer pipe (2) and said at least one inner pipe (3) are arranged coaxial to one another and wherein the difference between the inside diameter of said outer pipe (2) and the outside diameter of said at least one inner pipe (3) as well as the coefficient of expansion of said solid-state material (4) are dimensioned so that the varying expansion of pipes (2, 3) resulting from the heat acting during rolling on outer pipe (2) and conducted from the latter to the solid-state material (4) is approximately equalized by the expansion of the solid-state material (4).

5. The mandrel rod according to claim 4 wherein the coefficient of expansion of said solid-state material (4) is a multiple of that of the pipe materials.

6. The mandrel rod according to claim 1 wherein said outer pipe (2) and said at least one inner pipe (3) consist of steel.

7. The mandrel rod according to claim 1 wherein said solid-state material (4) consists of a thermosetting plastic.

8. The mandrel rod according to claim 1 wherein said solid-state material (4) consists of an epoxy resin or furan resin.

9. The mandrel rod according to claim 8 wherein an additive is mixed with the epoxy resin or furan resin to influence its heat conductivity and/or its coefficient of expansion.

10. The mandrel rod according to claim 9 wherein the additive consists of inorganic fibers of metal powder.

11. The mandrel rod according to claim 20 wherein said outer pipe (2), compared to said at least one inner pipe (3), has an increased outer hardness and quality.

12. The mandrel rod according to claim 11 wherein outer pipe (2) consists of high alloy steel, preferably nickel steel, and inner pipe or pies (3) consist of tonnage steel.

13. The mandrel rod according to claim 12 wherein a cooling pipe (9) is placed in inner or innermost pipe (3).

14. The mandrel rod according to claim 1 wherein there are cooling channels in said solid-state material (4).

* * * * *